US006550725B1

(12) United States Patent
Watson

(10) Patent No.: US 6,550,725 B1
(45) Date of Patent: Apr. 22, 2003

(54) ADJUSTABLE FAN STAND

(76) Inventor: Dale E. Watson, 211 Jefferson St., Brighton, IL (US) 62012

( * ) Notice: Subject to any disclaimer, the term of this patent is extended or adjusted under 35 U.S.C. 154(b) by 0 days.

(21) Appl. No.: 10/062,070

(22) Filed: Feb. 4, 2002

(51) Int. Cl.[7] ..... A47G 23/02

(52) U.S. Cl. ..... 248/146; 248/130; 248/151; 248/152; 248/127; 416/246

(58) Field of Search ..... 248/146, 130, 248/151, 152, 127, 649, 188.2, 413, 163.1, 440.1, 188, 688, 441.1, 125.3, 125.2, 125.1; 416/246; 211/85.17

(56) References Cited

U.S. PATENT DOCUMENTS

| | | | | | |
|---|---|---|---|---|---|
| 639,917 | A | * | 12/1899 | Arnold | 248/125.2 |
| 2,868,558 | A | * | 1/1959 | Krauss | 280/47.13 |
| 3,405,894 | A | * | 10/1968 | Jordan et al. | 248/13 |
| 4,032,998 | A | * | 7/1977 | England | 4/111 |
| 4,229,890 | A | * | 10/1980 | Dropinski | 38/102.1 |
| 4,589,622 | A | * | 5/1986 | Hutter | 248/649 |
| 4,886,233 | A | * | 12/1989 | Bateman et al. | 248/647 |
| 5,368,262 | A | | 11/1994 | Garrity | 248/131 |
| 5,370,500 | A | * | 12/1994 | Thompson | 416/100 |
| 5,709,361 | A | | 1/1998 | Dalisy | 248/300 |
| 5,987,789 | A | * | 11/1999 | Lubina | 38/102.4 |
| D424,681 | S | | 5/2000 | Lozzio | D23/378 |

* cited by examiner

*Primary Examiner*—Kimberly Wood
(74) *Attorney, Agent, or Firm*—Don W. Weber

(57) ABSTRACT

An adjustable fan stand is presented. The fan stand has an essentially parallel-piped upper housing that would be slightly larger than the standard twenty-inch by six-inch box fan. The upper housing is supported by two legs which are also connected at the bottom by a support. The legs have perpendicular feet which allow the entire fan stand to remain in position when a box fan is placed inside the fan housing. The fan housing has a number of vertical holes and is connected to each of the legs by wingnuts. By utilizing the various sets of holes and tightening or loosening the wingnuts, the height of the box fan above the floor may be adjusted as desired. The pitch of the box fan may also be adjusted to direct the cooling air to the upper torso of a worker as desired.

1 Claim, 2 Drawing Sheets

ADJUSTABLE FAN STAND

BACKGROUND OF THE INVENTION

This invention relates to the field of fans. More particularly, an adjustable stand for a box fan is presented.

Fans have been known for thousands of years. Since the advent of electricity certain types of electrical fans have been in common use throughout the world. The fans are usually located on pedestals or shelves.

One example of a portable stand fan located on a pedestal is found in the 2000 design patent, U.S. Pat. No. D424,681. This type of pedestal fan stand provides for a certain amount of adjustment of the direction of the fan, as shown in the Lozzio design patent noted above. One drawback of the pedestal-type fans is that the vertical height and angle of the fan is not adjustable. Further, the fan and stand, as typified by the Lozzio design patent, are sold as a unit. It is an object of this invention to provide a fan stand accommodating a normal box fan that is manufactured separately from the fan.

While fans come in many different types and shapes, a very common type of fan is known as the "box fan". A box fan is essentially square in shape having a length and height of about twenty inches. The standard box fan is normally approximately four to six inches in width. It is another object of this invention to provide an adjustable stand for a common box fan.

Adjustable mounting supports for box fans have been previously disclosed in the art. For example, the 1994 patent issued to Garrity, U.S. Pat. No. 5,368,260, discloses a means for mounting a box fan in a window. The Garrity mounting means merely secures the fan to the window however. Garrity does not disclose or teach a stand for a box fan which would enable the user of a box fan to elevate the fan to the desired level or to adjust the angle of orientation of the fan. It is a still further object of this invention to provide a stand for a common box fan that allows the user to adjust the height of the box fan from the floor and to adjust the angle of orientation of the box fan with respect to the floor.

Box fans are commonly used in shops or other open areas to cool workers in the shop. However, the average height of a worker would be between 5 feet and 6½ feet. Therefore, a box fan sitting on the floor of a shop would cool the worker's legs but not his torso or head. It is a still further object of this invention to provide a stand for a box fan which may be elevated such that the box fan discharges its cool air towards a worker's torso and/or head.

Other and further objections of this invention will become apparent upon reading the below described Specification.

BRIEF DESCRIPTION OF THE INVENTION

A stand for a box fan is presented having a lower base and an upper housing. The upper housing is constructed such that a standard box fan slips inside the outer perimeter of the fan stand housing. The fan stand also has lower vertical legs and perpendicular feet. The upper fan housing is adjustably attached to the left and right lower legs by means of screws and wing nuts or other attaching means. Since the sides of the upper housing have a number of corresponding holes, the fan housing, and hence the inserted box fan, can be raised or lowered depending upon which set of corresponding holes in the sides of the housing are attached to the left and right leg supports. Further, the box fan can be adjusted such that the fan may be pointed either slightly upward or slightly downward.

DETAILED DESCRIPTION OF THE PREFERRED EMBODIMENT

Figure 1:
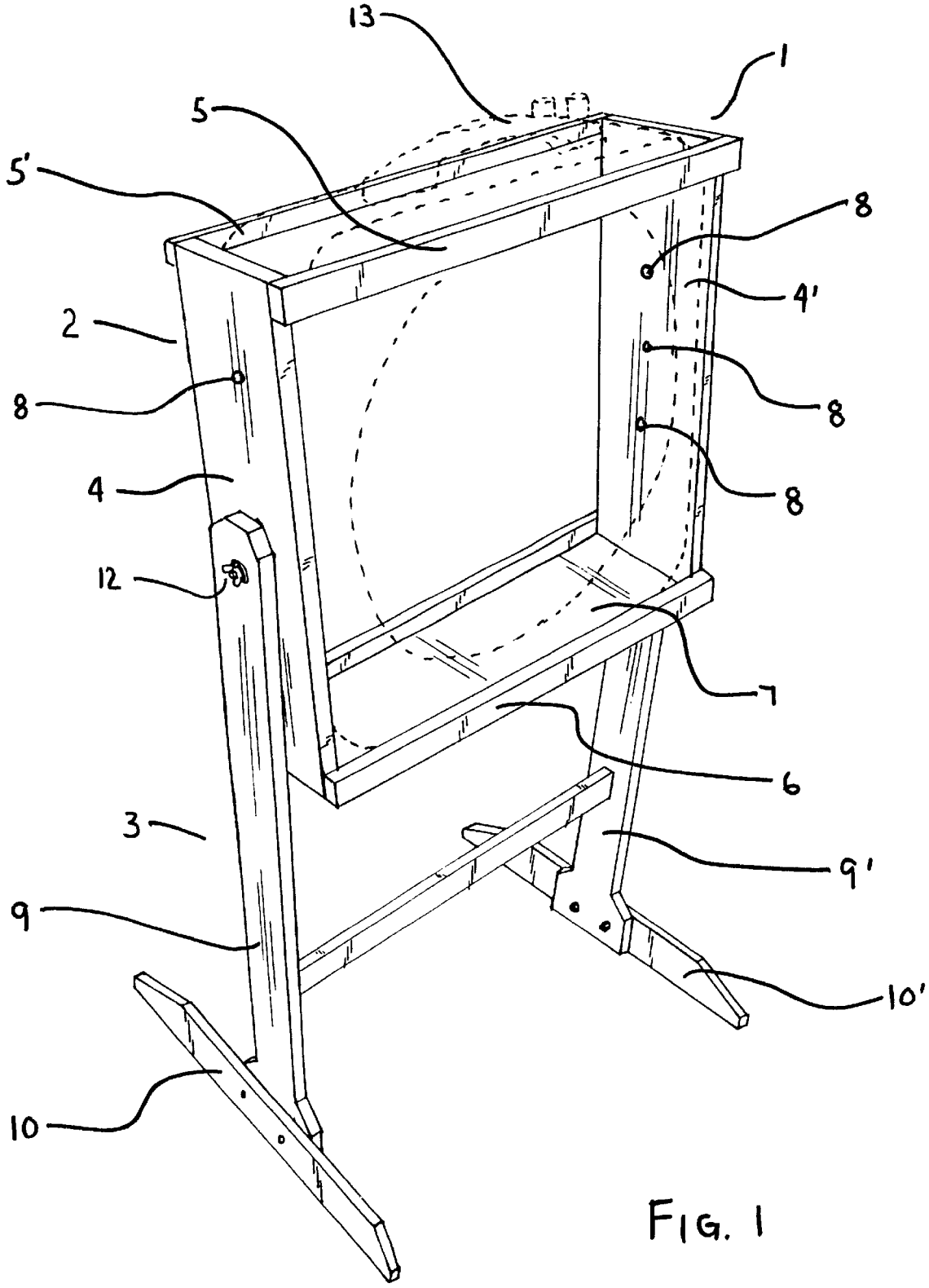
FIG. 1 is a perspective view of the fan stand.
Figure 4:
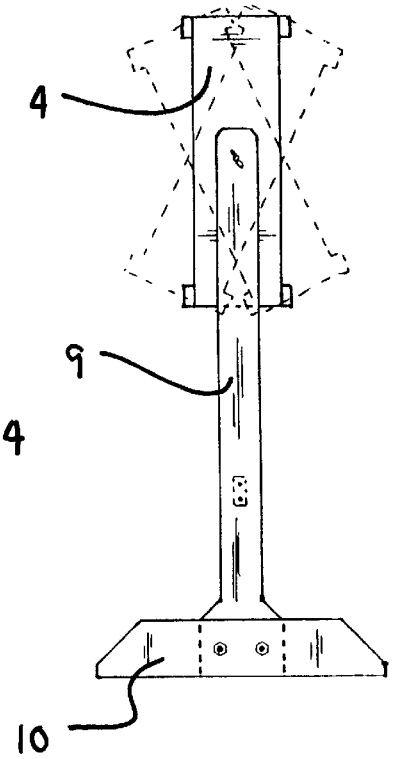
FIG. 4 is a side view of the fan stand; showing the slightly downward or slightly upward orientation of the fan housing in phantom lines.
Figure 2:
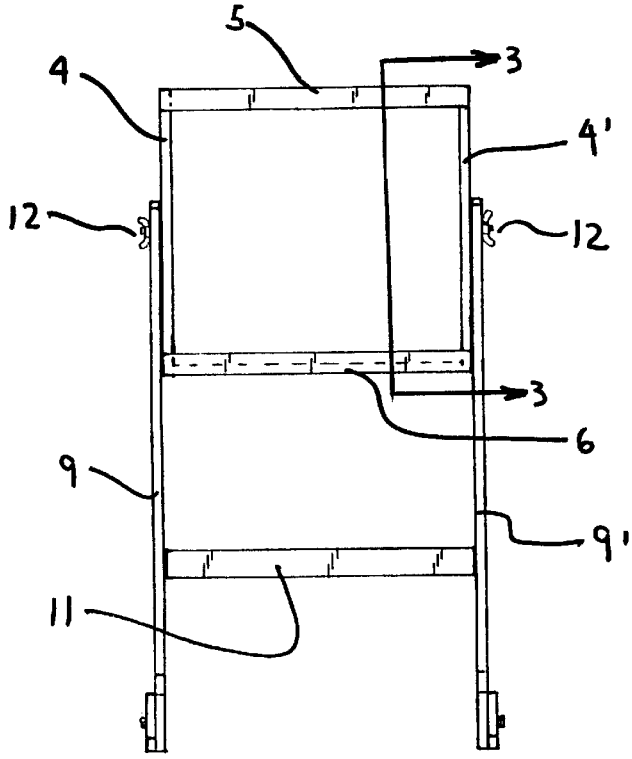
FIG. 2 is a front view of the fan stand.

An adjustable fan stand 1 is presented, as best shown in FIGS. 1, 2 and 4. The adjustable fan stand comprises two essential parts, being an upper fan housing 2 and a lower housing base 3.

The upper fan housing 2 has an essentially parallel-piped configuration with left 4 and right 4' vertical solid sides. The vertical sides of the fan housing are connected at the top by upper front 5 and upper back 5' horizontal braces. The left and right vertical sides are also connected at the bottom of the sides by lower front 6 and lower back 6' horizontal braces.

A cross section of the upper fan housing 2 would be approximately 21½ inches square and approximately 7 inches wide. It has been found that these approximate dimensions enable the standard manufactured box fan to fit easily yet snugly within the inner volume of the fan housing. A typical box fan 13 is shown in phantom in FIG. 1 as it would be inserted into the upper fan housing 2. Typically, the upper and lower front and back horizontal braces would have a cross section of approximately one-inch by two inches.

While the top section of the fan housing 2 is open, as best shown in FIG. 1, the bottom of the fan housing 2 has a lower horizontal bottom 7. The box fan rests on the lower horizontal bottom 7 and is secured within the fan housing 2 by means of the upper front 5 and back 5' horizontal braces and the lower front 6 and back 6' horizontal braces as shown in FIG. 1.

Figure 3:
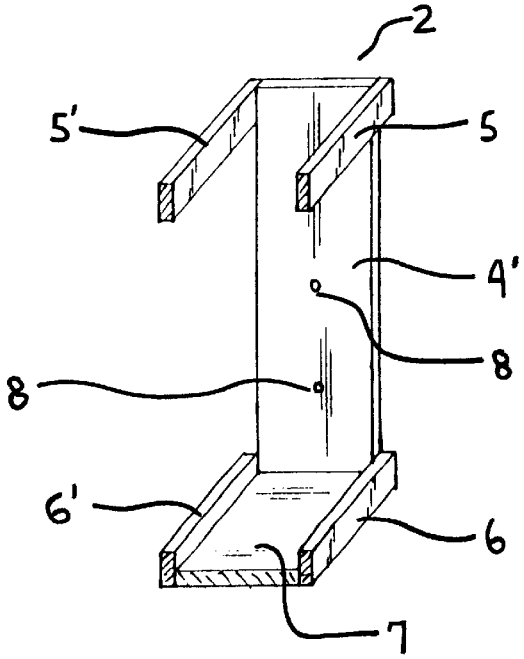
FIG. 3 is a perspective cutaway view of the upper fan housing, taken along lines 3—3 of FIG. 2.

Each left 4 and right 4' vertical side has a plurality of vertical side adjusting holes 8, as best shown in FIGS. 1 and 3. These side adjusting holes allow the upper housing 2 to be adapted to different heights according to where the upper housing 2 is attached to the lower vertical legs 9 and 9'. One adjusting hole is located generally midway between the top and bottom of the fan housing. This hole would be located approximately 10¼ inches from the bottom 7 of the upper housing 2. A plurality of other corresponding holes would be placed approximately four to six inches apart in the center of each vertical side. The holes correspond to each other with respect to their vertical height and central horizontal position. A set of corresponding vertical holes 8 in each side is used to position the fan at the desired height.

The upper housing 2 is supported by left 9 and right 9' vertical legs. The left leg is supported by a left 16 perpendicular foot while the right leg is supported by a right 10' perpendicular foot. The left and right vertical legs are also reinforced by a horizontal leg stabilizer 11 as best shown in FIG. 2.

The left 9 and right 9' vertical legs also include an upper fastening hole. This upper fastening hole is adapted to receive the wingnut fastening means 12, as best shown in FIGS. 1 and 2.

In order to use the adjustable fan stand, the left and right legs, joined by the horizontal leg stabilizer, is first put in a position in the shop or home suitable to the purposes of the user. The upper fan housing 2 is then adjustably fastened to the left and right vertical legs by means of the wingnut fastening means 12. The height of the fan from the floor may be adjusted by the simple method of selecting the desired corresponding holes 8. For example, to adjust the height of the fan to its tallest, one would use the lower set of corresponding holes in the left and right sides of the housing. To adjust the fan to its lowest height, one would use the upper set of corresponding holes. To adjust the fan at its normal or average height, one would use the middle holes, which are approximately 10¼ inches from the bottom 7 of the upper housing.

Once the upper housing 2 has been connected to the lower vertical legs 9 and 9', the box fan 13 may be inserted inside the upper housing, as shown by the phantom lines in FIG. 1. The upper fan housing 2, and hence the box fan inserted therein, may be tilted as shown in FIG. 4. Once the fan housing is tilted to the desired angle, the wingnuts 12 may be tightened such that the fan remains in the titled position desired.

Generally, a ¼ inch by 1¾-inch bolt and wingnut tightener is the fastening means used to adjustably connect the upper fan housing 2 to the lower legs 9 and 9'. The horizontal leg stabilizer, 11 is approximately one inch by 3 inches by 21½ inches long. The leg stabilizer is normally connected to the lower portion of the legs by means of wood screws. The perpendicular feet 10 are normally approximately 20 inches long and are connected to the lower portion of the vertical legs by means of ⅛ inch by 1¾-inch wood screws.

While the above dimensions are of the preferred embodiment, it may be readily understood that the dimensions are set out here as a means of illustration only and not as a limitation. Obviously, the height of the leg, the size, dimensions, and geometric shape of the feet, as well as the size and general configuration of the upper housing can be varied slightly while still keeping within the spirit and disclosure of this invention.

While the adjustable fan stand is generally made of wood, it could also be made of metal, plastic, or other type of suitable material.

It has been found that the use of this adjustable fan stand enables a workman to not only adjust the fan to nearly the height of his torso, but also to adjust the output of the cooling fan air towards the torso and head of the workman by tipping the fan housing as above described.

Having fully described my invention, I claim:

1. An adjustable fan stand for a standard box fan, comprising:

(a) left and right corresponding vertical legs each having a perpendicular foot support attached at the bottom of the leg, wherein each leg has an upper fastening hole;

(b) an upper fan housing, comprising left and right solid vertical sides connected at the top by upper front and back horizontal braces and at the bottom by lower front and back horizontal braces and a lower horizontal bottom connected to the bottom of each vertical side;

wherein, each of said vertical sides has a plurality of corresponding side adjusting holes located in the center of each vertical side at a plurality of vertical positions;

(c) fan housing connecting means comprising a wingnut fastening means; and (d) a lower, horizontal leg stabilizer connecting the lower parts of said legs together;

whereby a standard box fan may be detachably inserted into said upper fan housing; and whereby said fan and fan housing may be adjusted vertically and tilted.

* * * * *